US005541578A

United States Patent [19]

Lussey

[11] Patent Number: 5,541,578

[45] Date of Patent: Jul. 30, 1996

[54] TAMPER DETECTION SENSOR

[76] Inventor: David Lussey, Perapedhi, Tunstall, Richmond, North Yorkshire, DL10 7Ql, United Kingdom

[21] Appl. No.: 446,851

[22] PCT Filed: Dec. 1, 1993

[86] PCT No.: PCT/GB93/02471

§ 371 Date: Jun. 5, 1995

§ 102(e) Date: Jun. 5, 1995

[87] PCT Pub. No.: WO94/14142

PCT Pub. Date: Jun. 23, 1994

[30] Foreign Application Priority Data

Dec. 8, 1992 [GB] United Kingdom ..... 9225654

[51] Int. Cl.[6] ..... G08B 13/14

[52] U.S. Cl. ..... 340/571; 340/568; 340/665

[58] Field of Search ..... 340/571, 572, 340/568, 652, 657, 665, 540

[56] References Cited

U.S. PATENT DOCUMENTS

| | | | |
|---|---|---|---|
| 3,932,857 | 1/1976 | Way et al. | 340/652 |
| 4,000,488 | 12/1976 | Ephraim | 340/572 |
| 4,772,878 | 9/1988 | Kane | 340/568 |
| 5,237,307 | 8/1993 | Gritton | 340/572 |
| 5,406,263 | 4/1995 | Tuttle | 340/652 |

*Primary Examiner*—Glen Swann
*Attorney, Agent, or Firm*—Larson and Taylor

[57] ABSTRACT

A tamper detection sensor comprises an insulating substrate (2) to one side of which are applied electrically isolated strips (4) of an electrically conductive material, an electrically conductive bride member (8) interconnecting the strips (4) and secured to the strips (4) by an electrically conductive adhesive (10), and a layer (12) of electrically non-conductive adhesive applied to the one side of the substrate (2) to encase the conductive strips (4) and the bridge member (8) and by which the sensor can be secured to an item (14) to be protected. On relative movement between the substrate (2) and the layer (12) of non-conductive adhesive, the conductive adhesive (10) is deformed whereby the electrical resistance thereof is altered, this alteration in resistance being detected by an electronic monitor (18) connected to the sensor to provide an indication of the relative movement and therefore of tampering with the sensor.

10 Claims, 1 Drawing Sheet

TAMPER DETECTION SENSOR

TECHNICAL FIELD

The present invention relates to a sensor capable of detecting when an associated device is being tampered with, and has particular application to the protection of high-priced electrical equipment readily accessible to the public and therefore prone to theft or vandalism.

BACKGROUND ART

A problem currently exists in the security of high-priced electrical equipment, such as computer terminals, electronic printers, photocopying machines, video recording machines and other such items which are often installed in schools and other public places to which numbers of people have relatively free access. Such equipment is prone to theft or vandalism.

Furthermore, retailers stocking and displaying such items suffer from the same problems, attempted and successful illegal removal of electrical and electronic goods being a major source of financial loss to such organisations.

It has been proposed to overcome these problems by physically securing the equipment to an associated bench or table on which it stands, or, in the case of free standing equipment, to the nearest large fixture. However, such action often requires physical alteration to the external casing of the equipment, which can render the guarantee or warranty on the equipment invalid, while the nuts and bolts or flexible cables, chains and the like used to effect the mechanical securement can be removed or clipped through by a determined thief.

Electrical and electronic sensors have also been provided to activate associated alarm systems as and when attempts to remove an associated item are made. More particularly, such sensors may comprise loop alarms including a loop of wire passing through an aperture in the article to be protected and through which an electric current passes. If the loop is broken, as would be necessary to remove the article, an alarm sounds. Such devices suffer from a number of disadvantages, not the least of which is that an item to be protected must include an aperture through which the loop can pass.

It has also been proposed to provide electrical and electronic sensors which can be adhered to the outer casing of the item to be protected such that, on attempted removal of the sensor from the item, an associated alarm is activated. Such sensors commonly rely upon the movement of a mechanical member to make or break an associated electric circuit thereby to trigger an alarm, and are usually of relatively complex and bulky construction and are expensive to produce.

Electrical membrane press switches are generally known and are usually of a fairly compact nature, commonly being of a laminar construction. It is also known to utilise a conductive adhesive to secure together the elements of such switches whereby said adhesive provides an electrically conductive path between said elements as well as physically securing the elements together.

DISCLOSURES OF THE INVENTION

It would be desirable to be able to provide a tamper detection sensor of relatively compact, simple and inexpensive construction for adhesion to an associated item to be protected in such a manner that any tampering with the sensor or attempted removal thereof from the item gives an immediate warning of such activities.

According to the present invention there is provided a tamper detection sensor comprising a substrate of an electrically insulating material to one side of which is applied an electrically conductive material including elements electrically isolated from one another, an electrically conductive bridge member interconnecting said elements and being secured to said elements by an electrically conductive adhesive, and a layer of electrically non-conductive adhesive applied to said one side of the substrate to encase said elements and bridge member and by which the sensor can be secured to an item to be protected, the arrangement being such that, on relative movement between the substrate and the layer of non-conductive adhesive, the conductive adhesive is deformed whereby the electrical resistance thereof is altered, said alteration in resistance being utilised to provide an indication of said relative movement.

It will thus be appreciated that such a sensor can be extremely compact in nature, preferably being of a thin, laminar construction, and is of relatively simple but stable construction, the bridge member, by way of the conductive adhesive, effectively acting as a very sensitive switching member, any deformation of the conductive adhesive, as a result of said relative movement, immediately altering the electrical characteristics of a circuit including the device therein.

In a preferred embodiment of the invention, the electrically conductive material, which is conveniently copper, comprises a pair of strips adjacent ends of which are spaced from one another, and a further conductive strip, which may be a thin lead alloy foil, bridging said adjacent ends and adhered thereto by droplets of conductive adhesive.

Alternatively, the bridge member may comprise conductive adhesive.

Conveniently the conductive adhesive comprises a synthetic rubber base to which has been added, for example, a metal powder, preferably nickel, in an amount of the order of 35% by volume.

Preferably the non-conductive adhesive comprises the same synthetic rubber as forms the base of the conductive adhesive.

The substrate may comprise a layer of rigid glass-fibre-reinforced plastic to which the conductive material is secured by a strong resinous thermosetting adhesive.

Conveniently the sensor is included in an electrical circuit comprising a power source, for example a battery, and an electronic monitor the condition of which is altered on a change in the resistance of the conductive adhesive. The circuit may further include an audible or inaudible alarm, an event recorder, a visual alarm or the like which is activated on any change in resistance of the conductive adhesive.

DETAILED DESCRIPTION OF THE PREFERRED EMBODIMENT

Figure 1:
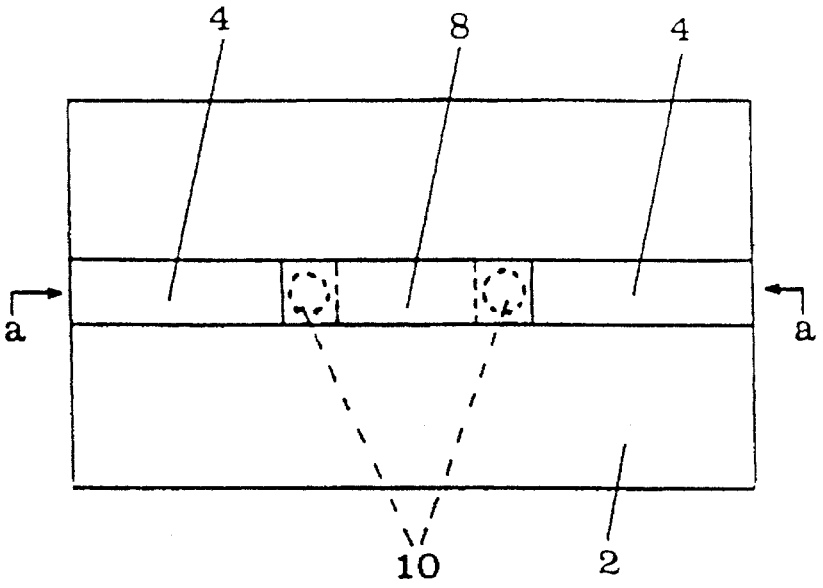
FIG. 1 is a plan view from above of the sensor according to the invention.

Referring to the drawings, the illustrated sensor includes a thin, rigid substrate 2 of a non-conductive material such as glass-fibre-reinforced plastic to one surface of which are secured, for example by a strong resinous thermosetting adhesive, a pair of conductive strips 4, for example of copper.

Figure 2:
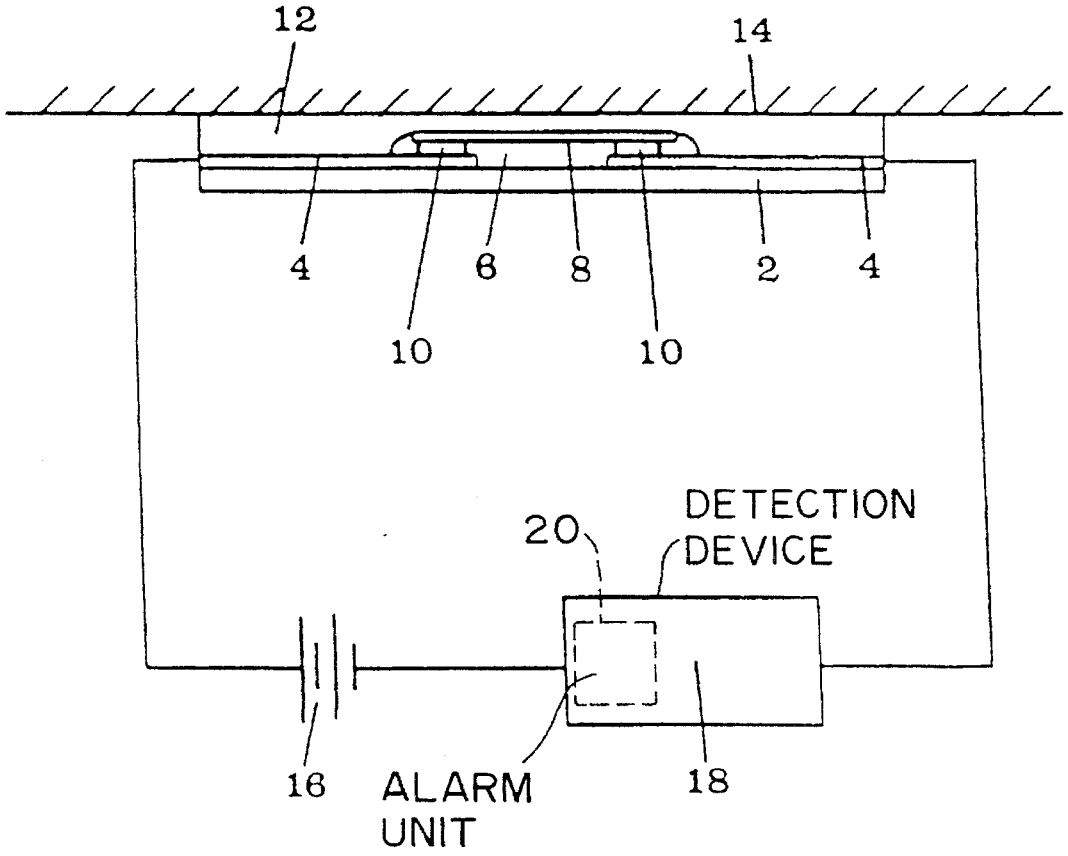
FIG. 2 is a section on the line a—a of the sensor of FIG. 1 adhered to an item to be protected and incorporated in an associated circuit.

Adjacent first ends of the strips 4 are spaced slightly apart as best seen in FIG. 2 to define a gap 6 therebetween, while the other ends of said strips, at or adjacent the edges of the substrate 2, are suitably placed for the connection thereto of associated leads as will be detailed below.

A bridge member 8 in the form of a thin strip of a conductive material such as lead alloy foil extends across the gap 6 and is secured to the first ends of the strips 4 by a flexible conductive adhesive 10 whereby said bridge member 8 and the adhesive 10 provide electrical continuity between the strips 4.

A thin flexible layer 12 of non-conductive adhesive is provided on said one side of the substrate 2 substantially to encase the strips 4 and the bridge member 8, said layer enabling the sensor to be secured to an item 14 to be protected.

More particularly, the conductive adhesive 10 comprises a synthetic rubber base thinned to a workable consistency by a suitable solvent and to which is added typically 35% by volume of nickel powder to impart the necessary conductivity. However, conductors and semi-conductors other than metal powders may be added to the base material. The non-conductive adhesive 12 is preferably a self-stick adhesive comprising the same synthetic rubber as provides the base for the conductive adhesive.

In use, the self-adhesive face of the adhesive 12 is stuck onto the item 14, the other ends of the conductive strips 4 being wired to a source of power 16, conveniently a battery, the circuit also including an electronic device 18 capable of detecting any change in the electrical characteristics of the circuit.

It will be appreciated that, under normal operating conditions, the conductive strips 4 together with the bridge member 8 and the conductive adhesive 10 comprise components of a low resistance circuit the current flow through which can be monitored by the device 18.

In the described arrangement, the bond between the conductive strips 4 and the bridge member 8 effected by the conductive adhesive 10 is weaker than the bonds between the conductive strips 4 and the substrate 2, and between the non-conductive adhesive 12 and the underlying components of the sensor.

Consequently, if any attempt is made to remove the sensor from the item 14, deformation or, eventually, rupture of the conductive adhesive 10 will occur, this being the weakest bond within the sensor.

As soon as the conductive adhesive 10 is deformed, the inherent electrical characteristics thereof are altered. In particular, any stretching of the conductive adhesive 10 causes an increase in its electrical resistance and a consequential reduction in the current flow through the associated circuit. This change is immediately detected by the device 18, and can be utilised to actuate an associated alarm system or unit 20.

The sensitivity of the sensor can be determined by the constituents and the amounts of the particular conductive adhesive 10 used, and it is preferred that a movement as small as 0.25 mm will stretch the conductive adhesive to its limit of deformation. In such an instance, the resistance of the conductive adhesive 10 is typically one ohm in its normal condition and increases to typically 2 million ohms at its limit of deformation. If the adhesive 10 is deformed beyond its elastic limits, it will break to establish an open circuit of infinite resistance.

The alarm system or unit 20 activated by the detection device 18 may be any one of a variety of types, for example audible, inaudible, visual, event recorder or the like.

In a preferred arrangement, the sensor is of thin laminar construction and is relatively insensitive to blows thereon tending to compress the conductive adhesive 10 whilst at the same time being extremely sensitive to any attempts to pull or twist the sensor from the item 14.

Clearly, however, the sensor can be produced in a variety of configurations with, for example, a plunger or socket attached to allow mobility to portable equipment or to simplify replacement of the sensor. If discrete protection is required, the sensors can be produced to very small sizes.

The conductive material 4 may be other than metal, for example a conductive ink, while the bridge member 8 may consist of conductive adhesive.

It is further preferred that, in all cases, both the conductive adhesive 10 and the non-conductive adhesive 12 are formulated to be similarly sensitive to the application of both heat and chemical solvents, while the bridge member 8 is preferably of a low-melting-point material to melt if heat is applied to the sensor in an attempt to remove it.

Thus there is provided a low cost sensor of relatively simple construction which is sensitive to the application of force, heat or solvents in an effort to remove it from its position on an item to be protected and which, on the application of force thereto, undergoes a change in electrical resistance which can be monitored by associated electronics to provide a warning or a record of tampering.

I claim:

1. A tamper detection sensor comprising a substrate of an electrically insulating material to one side of which is applied an electrically conductive material, said electrically conductive material including elements electrically isolated from one another, an electrically conductive bridge member interconnecting said elements and being secured to said elements by an electrically conductive adhesive, and a layer of electrically non-conductive adhesive applied to said one side of the substrate to encase said elements and bridge member and by which the sensor can be secured to an item to be protected, the arrangement being such that, on relative movement between the substrate and the layer of non-conductive adhesive, the conductive adhesive is deformed whereby the electrical resistance thereof is altered, said alteration in resistance being utilized to provide an indication of said relative movement.

2. A sensor as claimed in claim 1 in which the electrically conductive material comprises a pair of strips adjacent ends of which are spaced from one another, said electrically conductive bridge member bridging said adjacent ends and being adhered thereto by droplets of said conductive adhesive.

3. A sensor as claimed in claim 1 in which the bridge member comprises conductive adhesive.

4. A sensor as claimed in claim 1 in which the conductive adhesive comprises a synthetic rubber base to which has been added a metal powder.

5. A sensor as claimed in claim 4 in which the metal powder comprises nickel in an amount of the order of 35% by volume.

6. A sensor as claimed in claim 4 in which the non-conductive adhesive comprises the same synthetic rubber as forms the base of the conductive adhesive.

7. A sensor as claimed in claim 1 in which the substrate comprises a layer of rigid glass-fibre-reinforced plastic to which the conductive material is secured by a resinous, thermosetting adhesive.

8. A sensor as claimed in claim 1 and included in an electric circuit comprising a power source and an electronic monitor the condition of which is altered on a change in the resistance of the conductive adhesive.

9. A sensor as claimed in claim 8 in which the circuit further includes an alarm unit comprising any one of an audible alarm, an inaudible alarm, a visual alarm and an event recorder which is actuated on any change in resistance of the conductive adhesive.

10. A sensor as claimed in claim 1 and of thin, laminar construction.

* * * * *